United States Patent [19]

Kifferstein

[11] Patent Number: 4,480,828

[45] **Date of Patent: * Nov. 6, 1984**

[54] MUTED RHYTHM INDICATING EXERCISERS

[76] Inventor: Harry P. Kifferstein, 27250 Harvard Rd., Southfield, Mich. 48076

[ * ] Notice: The portion of the term of this patent subsequent to Jul. 14, 1998 has been disclaimed.

[21] Appl. No.: 376,249

[22] Filed: May 10, 1982

Related U.S. Application Data

[63] Continuation-in-part of Ser. No. 180,840, Aug. 25, 1980, Pat. No. 4,366,956, which is a continuation of Ser. No. 51,113, Jun. 22, 1979, Pat. No. 4,278,248.

[51] Int. Cl.[3] ..... A63B 21/00

[52] U.S. Cl. ..... 272/70; 272/117; 446/419

[58] Field of Search ..... 272/117, 123, 122, 124, 272/128, 67, 68, 70; 46/191, 193

[56] References Cited

U.S. PATENT DOCUMENTS

| | | | |
|---|---|---|---|
| 466,276 | 12/1891 | La Garde | 272/122 |
| 2,268,684 | 1/1942 | Zadek | 46/193 |
| 2,509,810 | 5/1950 | Core | 272/122 |
| 3,006,646 | 10/1961 | Nanni | 272/67 |
| 3,514,898 | 6/1970 | Price | 46/191 |
| 4,218,057 | 8/1980 | Wilson | 272/117 |
| 4,278,248 | 7/1981 | Kifferstein | 272/68 |

FOREIGN PATENT DOCUMENTS

| | | | |
|---|---|---|---|
| 855312 | 11/1960 | United Kingdom | 272/128 |

*Primary Examiner*—Richard J. Johnson
*Attorney, Agent, or Firm*—Hauke & Patalidis

[57] ABSTRACT

A rhythm indicating exercising device in the form of a generally tubular member having a preferably metallic mass or slug disposed freely slidable in the interior of the tubular member, each end of the tubular member being provided with an elastic, resilient end closure preventing the mass or slug from escaping from the tubular member. In use, one tubular member is grasped in one hand or, preferably, a pair of tubular members are held one in each hand of a person while walking and more particularly while engaged in aggressive exercise walking, that is while walking at a fast pace with extensive swinging of the arms back and forth. At the end of each forward and backward stroke of the arm, the mass or slug is forcibly propelled by inertia within the tubular member and caused to strike the corresponding end closure, thus producing a muted impact knocking sound helping the walker to maintain an effective rhythm and providing beneficial advantages in indicating proper exercising of the arms in addition to the legs.

24 Claims, 16 Drawing Figures

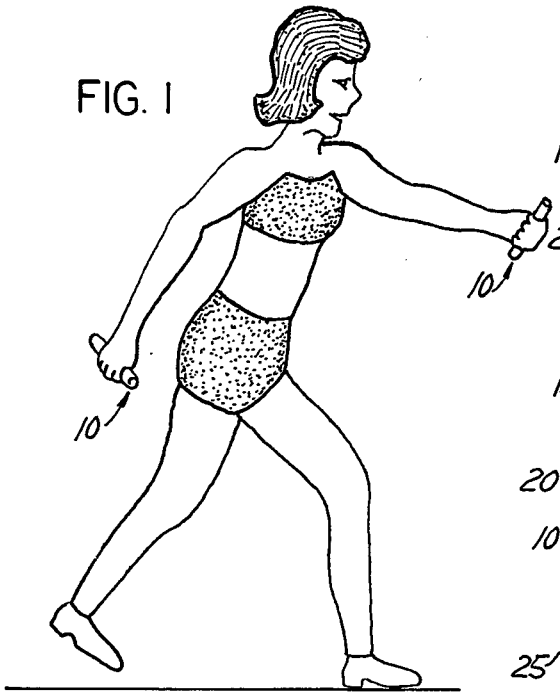
FIG. 1
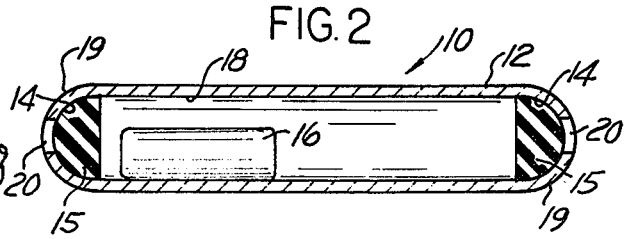
FIG. 2
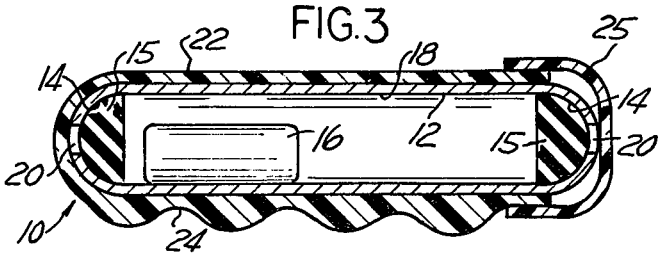
FIG. 3
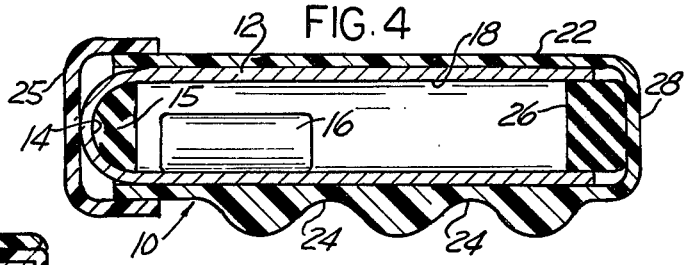
FIG. 4
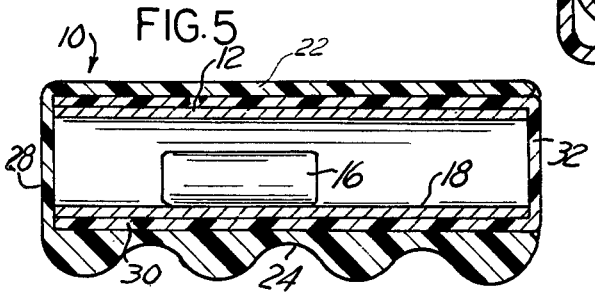
FIG. 5
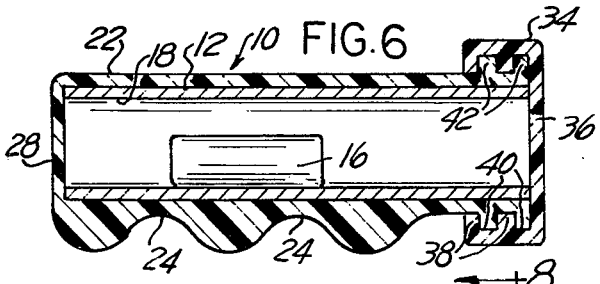
FIG. 6
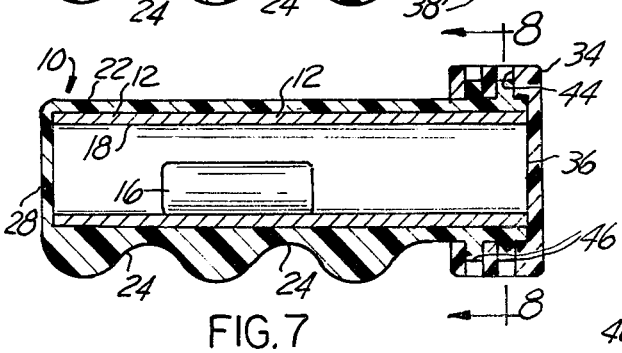
FIG. 7
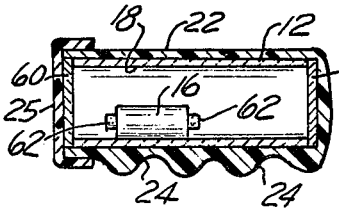
FIG. 9
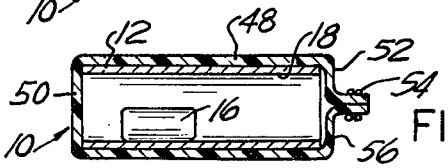
FIG. 10
FIG. 11
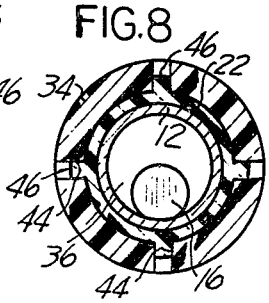
FIG. 8
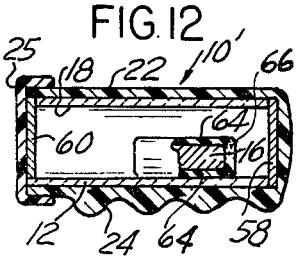
FIG. 12

MUTED RHYTHM INDICATING EXERCISERS

CROSS-REFERENCE TO RELATED APPLICATION

The present application is a continuation-in-part of application Ser. No. 180,840, filed Aug. 25, 1980, now Letters Pat. No. 4,366,956, issued Jan. 4, 1983, which, in turn, is a continuation of application Ser. No. 51,113, filed June 22, 1979, now Letters Pat. No. 4,278,248, issued July 16, 1981;

BACKGROUND OF THE PRESENT INVENTION

Recent years have witnessed a remarkable growth in "jogging". One advantage is that jogging does not require any auxiliary equipment short of an appropriately fashionable garb, preferably of bright colors. Another advantage of jogging is that it appears, at least when indulged in within the physical limitations of the jogger, to be a healthfully beneficial endeavor providing a good muscular and cardiovascular exercise resulting in improved stamina, intensified perspiration and consequential loss of undesirable and undesired weight through active burning of body fat and elimination of tissue water. However, jogging has also many health inconveniences, either momentary and reversible or permanent and irreversible, such as, for example, arrhythmia, tachycardia, ventricular fibrilation, hyperventilation, muscle cramps, endurance fatigue ad stress, kidney and urinary disorders, stomach and intestinal problems, feet blistering, carbon monoxide inhalation, broken bones, worn-out joints, chronic joint and lung inflamation, ruptured ligaments and tendons, and dog bites.

An alternate to jogging is walking. Walking is a natural human action which, while still enjoyed by a few, has fallen into disrepute in view of the more conventional alternative provided by motorized mass and private transportation. This disrepute has reached the point that walking, one of man's and woman's most natural functions, is often casually prescribed by physicians, ironically for its therapeutic value. Walking, however, does not require any special equipment or field, court, rink, course or pool. Walking does not require any special clothing, garb, or uniform.

Long distance walking, or marathon walking, is a very popular competitive sport long practiced in many countries, recognized by sporting clubs and associations, and rewarded by national and international championships. Such competitive aggressive fast-paced walking takes place under strict rules, one of which requiring that each step be effected with the heel of the foot first contacting the ground. Competitive marathon walkers, or marchers, are, in the course of a officially sponsored contest, under constant observation and scrutiny by umpires and referees and immediately disqualified if violating any of the rules.

Competitive walkers, or marchers, walk at a rhythmic pace and fling their extended arms, using their shoulders as pivots, in synchronized timing with the walking legs, the right and left arms swinging rhythmically in opposite directions to the strides of respectively right and left legs. In other words, simultaneously with throwing his or her right leg forward, the competitive walker throws his or her right arm backward and his or her left arm forward, and vice versa. Competitive walkers are complete athletes, with fully developed muscles in the arms, neck, shoulders, upper and lower back, chest, belly as well as the legs.

Without engaging into such an aggressive competitive walking, any average person can achieve his or her sought-after physical fitness, and in addition benefits from greatly improved muscular functions, strengthened heart muscles, and increased cardiac output, pulmonary capacity and physical stamina and endurance, by exercising through aggressive walking without suffering the inconveniences, pains and side effects of jogging. Although walking, like bicycling, may be enjoyed at a leisurely pace, it must be practiced in a somewhat vigorous and aggressive manner, in the form of an exercise, in order to attain all of the expected physical and health advantages. It has been noted, however, that most "amateur" walkers tend to be originally lax in properly and vigorously swinging their arms in time with their leg strides or, if at first somewhat energetic in their arm action, they tend to become progressively lax after a short period of time.

There is therefore a need for an exercising device for aiding an aggressive walker to achieve proper motion-timing and, in addition, providing a indicator of adequate arm motions in synchronism with leg motions. The inventions disclosed in the aforesaid prior patent and application and in the following description provide such a rhythm indicator, arm exerciser and detector of proper arm actions for a person engaged in practicing vigorous, aggressive walking while, at the same time, providing him or her with a relatively light hand-supported load, which, if so desired, can be progressively increased as arm and shoulder muscles develop. It has experimentally been determined, through the use of tests such as commonly referred to as "stress tests" wherein a subject is caused to walk vigorously on a power-driven belt or "treadle", that oxygen lung intake is increased by approximately 20–25% through the proper use of the invention, as compared to running the same tests in the usual manner with the subject grasping the test device handle bar and keeping his or her arms motionless.

In the aforesaid patent and patent application, there is disclosed simple hand graspable rhythm indicating exercisers which, in addition to functioning as rhythm indicators, act as detectors of appropriate swinging of the arms during vigorous, aggressive walking, and which can be used as training tools by the average person attempting to improve his or her physical well-being and aptitudes, as well as by athletes aiming at improved performances. The rhythm indicating exercising devices disclosed in said patent and application for patent are in the form of a generally tubular member having a weighted mass or slug, preferably metallic, disposed freely slidable in the interior of the tubular member, each end of the tubular member being provided with an arresting member or closure wall preventing the mass or slug from escaping from the tubular member. In use, the tubular member is grasped in one hand or, a pair of tubular members are held one in each hand of a person while walking at a fast pace with extensive swinging of the arms. The mass or slug is forcibly propelled by inertia within the tubular member and caused to strike one of the closures, thus producing an impact knocking sound, clearly audible, helping the walker to maintain an effective rhythm and providing beneficial advantages in indicating proper exercising of the arms in addition to the legs.

SUMMARY OF THE INVENTION

The principal object of the present invention is to provide a rhythm indicator and detector of proper swinging of the arms during vigorous, aggressive walking which emit a muted knocking sound each time the weighted mass or slug impacts upon an end wall of the tubular member. The diverse objects and advantages of the present invention will become apparent to those skilled in the art when the following description of examples of the best modes contemplated for practicing the invention is read in conjunction with the accompanying drawing wherein like numerals refer to like or equivalent parts and in which:

BRIEF DESCRIPTION OF THE DRAWING

FIG. 1 is a schematic representation of a person engaged in vigorous, aggressive walking while using the present invention;

FIG. 2 is a longitudinal section of an example of structure for a rhythm indicator exerciser according to the present invention;

FIGS. 3–7 are views similar to FIG. 2 but showing modifications thereof;

FIG. 8 is a cross-section through line 8—8 of FIG. 7;

FIG. 9 is a longitudinal section through another example of structure for a rhythm indicator exerciser according to the present invention, shown in the course of being assembled;

FIG. 10 is a view similar to FIG. 9 but showing the rhythm indicator exerciser of the invention fully assembled;

FIG. 11 is a view similar to FIG. 5 but showing a modification thereof;

FIG. 12 is a view similar to FIG. 11 but showing a modification thereof;

DETAILED DESCRIPTION OF THE PREFERRED EMBODIMENTS

Figure 13:
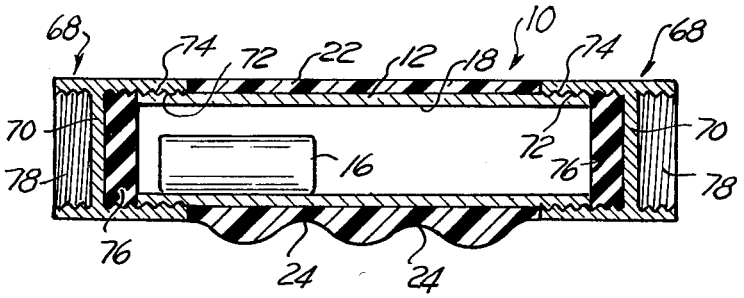
FIGS. 13–14 are further views similar to FIG. 2, but showing a further modification thereof.

Referring to FIG. 1, there is schematically illustrated a walker engaged in vigorous, aggressive walking, while holding in his or her hand a rhythm indicator and exerciser device 10 according to the present invention. In order to properly exercise the upper torso and, more particularly, the back, the chest, the shoulder and the arm muscles, and in order to establish proper balance and natural stride while engaging in aggressive walking, when the right leg, for example, is propelled forwardly the right arm is swung vigorously backward, pivoting around the shoulder, and the end of the backward swing of the arm corresponds substantially in real time to the end of the forward stroke of the right leg, and vice versa. Each arm is therefore caused to be swung backward approximately to the limit permissible without undue strain and, subsequently and in synchronism with the motion of the legs, swung forward to at least a substantially horizontal position. By carrying a rhythm indicator and exerciser device 10 according to any one of the structures disclosed herein, and as illustrated at FIGS. 2–12, an appropriate muted knocking sound is felt, rather than heard, by the walker at the end of the back swing of each arm, and again is felt, rather than heard, at the end of the forward swing of each arm. In this manner, at least two important results are achieved by the user of the invention. First, he or she is able to determine when sufficient swing of the arm has been achieved when an impact sound is dimly heard or felt at each end of the arm swing and, secondly, by proper synchronization of the impact muted sound heard, or impact shock felt, he or she is able to establish and maintain an appropriate rhythmic or cadence swinging of the arms coinciding appropriately with the cadence of the footsteps.

As illustrated in detail in longitudinal section at FIG. 2, each rhythm indicator and exerciser device 10, in its simplest form, comprises a tubular cylindrical member 2 provided at each end with a stop member or closure wall 14, a resilient cushion 15 being installed at each end of the tubular member 12. The closure walls 14 prevent a weighted mass or metallic slug 16, loosely disposed in the interior bore 18 of the tubular member 12, from being thrown out of the tubular member 12 either by inertia or by gravity in any position of the tubular member. When the tubular member 12, held in the hand of a person, is propelled in a direction along an arc of a circle and suddenly stopped, the weighted mass or slug 16, by inertia, impacts against one of the resilient cushions 15, and is caused to impact upon the other resilient cushion 15 as a result of the arm being swung in an opposite direction and of the sudden stopping of the motion of the arm. Each time the weighted mass or slug 16 impacts upon a resilient cushion 15, a somewhat muted knocking sound is emitted, and the impact is felt through the hand of the user indicating to the user that an appropriate amount of energy has been used for swinging the arm and that the motion of the arm has been stopped at the intended upward end of the swing arc.

In the structure of FIG. 2, the tubular member 12 is preferably metallic, although it may be made of a plastic material, and the end walls 14 are formed integrally by swaging the ends of the tubular member 12, as shown at 19, after cutting the tubular member to an appropriate length, introducing the weighted mass or slug 16 within the bore 18 in the tubular member 12 and disposing the resilient cushions 15 one at each end of the tubular member 12. The ends of the tubular member 12 are swaged only to the appropriate amount necessary for holding the resilient cushions 15, such that the end walls 14 are provided with an aperture 20, preferably of a diameter less than the overall diameter of the weighted mass or slug 16. The resilient cushions 15 are made of any appropriate rubber-like or elastomeric material, such as polypropylene and the like and are held in position under slight compression.

Preferably, the tubular member 12 has an outer diameter of about 25 mm to 50 mm, appropriate for enabling grasping the tubular member 12 in one hand, and has a length of, for example, 100 mm to 160 mm. Whether made of metal or plastic, the tubular member 12 may be used as such or, preferably, it is disposed in a sleeve 22, FIG. 3, made of rubber or other convenient material such as polypropylene and the like provided on one side with indentations, as shown at 24, to form a convenient, non-slipping hand grip. For the sake of convenience and for providing a good appearance a cap 25, made of the same material as the grip sleeve 22, is fastened on the other end of the tubular member 12. Although the sleeve 22 may be made of elastomeric material, it may be made of any convenient plastic material, even rigid plastic, as the elastomeric pads or cushions 15 provide appropriate absorption of the impact shocks at each end of the tubular member 12.

FIG. 4 illustrates another example of structure for a rhythm indicator and exerciser device 10 according to the present invention, consisting of a tubular member 12 provided with an integral closure wall 14 at one end of the bore 18 in the tubular member 12 and with an open end. A resilient, rubber-like, or elastomeric, cushion or bumper 15 is disposed at the closed end 14 of the bore 18 and a second resilient or elastomeric cushion 26 is disposed at the open end of the bore 18. A molded plastic tubular member or sleeve 22 provided with integrally mounted grip indentations 24 on one side is disposed over the tubular member 12. The molded plastic tubular member or sleeve 22 has a end wall 28 holding the resilient cushion 26 at the open end of the tubular member bore 18 securely in position. A cap 25 may be placed over the other end of the assembly to cover up the end wall 14 of the tubular member 12. The sleeve 22 may be made of rigid or elastomeric material.

Referring now to FIG. 5, there is illustrated a further modification of a rhythm indicator and exerciser device 10, according to the invention, comprising a tubular member 12 open at both ends, the weighted mass or slug 16 being freely disposed in the bore 18 of the tubular member 12. A sleeve 30 made of molded elastomeric plastic is resiliently and frictionally disposed over the tubular member 12. The sleeve 30 is open at an end and closed at the other and, as shown at 32, such as to close one end of the bore 18 of the tubular member 12. A grip sleeve 22, provided with appropriate indentations 24, and made also of elastomeric plastic material, is disposed over the sleeve 30. The grip sleeve 22 is open at one end and has an end wall 28 at the other end closing the other open end of the bore 18. In this manner, each time the weighted mass or slug 16, freely disposed in the bore 18, impacts upon an end wall 28 or 32, the impact noise is substantially muted, hardly audible, but nevertheless can be felt through the hand holding the rhythm indicator and exerciser device 10. Both the outer sleeve 22 and the inner sleeve 30, fitted over the tubular member 12, are made of elastic, resilient and stretchable material such as rubber or an elastomeric plastic, such as polypropylene and the like, and each has an internal diameter less than, respectively, the outer diameter of the inner sleeve 30 and the outer diameter of the tubular member 12, with the result that they must be stretched elastically in order to be passed over the respective member disposed within each sleeve, thus providing a sturdy assembly, with no risk of separation of the elements.

In the structure of FIG. 6, the tubular member 12, open on both ends, is disposed in an elastic stretchable grip sleeve 22 providing a resilient end wall 28 for closing an end of the bore 18 in the tubular member 12. The other end of the bore 18 is closed by a closure cap 34 made also of elastomeric material and providing a resilient end wall 36 for the other open end of the tubular member 12. The closure cap 34 is elastically held in position over the sleeve 22 at the appropriate end by being provided with inwardly radially projecting annular portions 38 defining grooves 40 therebetween, and integral outwardly projecting annular portions 42 proximate the open end of the sleeve 22 interlock within the grooves 40 of the closure cap 34. If so desired, the surfaces of the corresponding grooves 40 and projecting annular portions 38 and 42 may be coated with an appropriate solvent or adhesive for the material used, or the closure cap 34 may be heat-welded to the sleeve 22, to form a permanent assembly.

The structure of the rhythm indicator and exerciser device of FIGS. 7–8 is substantially the same as the structure of FIG. 6, with the exception of the closure cap 34 being provided with a plurality of radial bores 44, for example in two parallel circular rows, into which snap corresponding pin-like projections 46 peripherally integrally formed proximate the open end of the grip sleeve 22.

FIGS. 9–10 illustrate a further example of simple structure for a rhythm indicator and exerciser device 10, consisting of a tubular member 12 encased in an elastomeric sleeve 48 having an end wall 50 closing an open end of the bore 18 in the tubular member 12. The elastomeric sleeve 48 is open at its other end in the form of a stretchable mouth 52 through which the weighted mass or slug 16 can be slipped during assembly, as shown at FIG. 9. After the weighted mass or slug 16 has been slipped into the bore 18 of the tubular member 12, the stretchable mouth 52 of the sleeve 48 is closed by any convenient means, for example by a tie 54, such as to define another resilient wall 56 closing the other end of the bore 18 and preventing the weighted mass or slug 16 from escaping from within the tubular member 12.

Instead of providing the bore 18 of the tubular member 12 with resilient closure end walls, the tubular member 12 may be provided with solid end walls 58 and 60, FIGS. 11 and 12, and the weighted mass or slug 16 provided at each end with an elastomeric pad or bumper 62, such as to mute the sound of impact when hitting one of the solid end walls 58 or 60, FIG. 11, or, alternatively, the solid metallic weighted mass or slug 16 may be coated with an elastomeric material, as shown at 64 at FIG. 12, the elastomeric material being preferably thicker, as shown at 66, at both ends of the weighted mass or slug 16.

Referring now to FIG. 13, a rhythm indicator and exerciser device 10 is illustrated as comprising a cylindrical tubular member 12, preferably made of metal, a weighted mass or slug 16 being disposed in the tubular member bore 18. A sleeve 22, provided with finger-grip indentations 24, is disposed around the tubular member 12. Each end of the bore 18 in the tubular member 12 is closed by an end cap 68. Each end cap 68, made of rigid plastic or preferably metal, is in the form of a cylindrical tubular plug provided with an integral partition wall 70. The internal surface of each end cap 68, on one side of the partition wall 70, is provided with an internal thread 72 engaged over a peripheral external thread 74 formed at each end of the tubular member 12. an elastomeric cushion or pad 76 is bonded or otherwise fastened on one side of the partition wall 70, such that when the weighted mass or slug 16 impacts upon an elastomeric cushion or pad 76 at each end of its travel within the bore 18, a muted impact noise is emitted. However, if the user prefers to obtain an audible impact sound, by removing each end cap 68, turning the end cap around such as to install each end cap 68 on the end of the tubular member 12 by threading the internal thread 78 formed on the inner surface of each end cap 68 on the other side of the partition wall 70, the solid partition wall 70, FIG. 14, is directly impacted by the weighted mass or slug 16 at the end of each stroke thereof, such as to emit an audible knocking sound.

Figure 14:
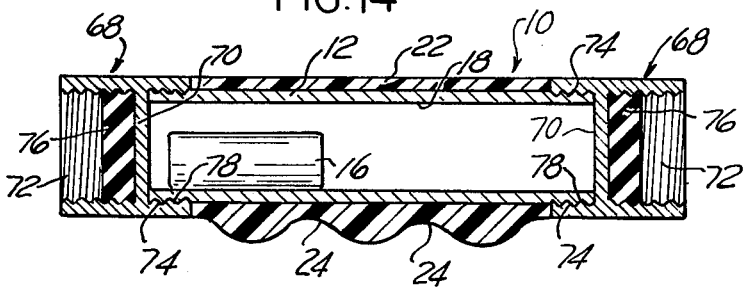

The structure of FIGS. 13–14 thus provides a convertible structure for the rhythm indicator and exerciser device of the invention, permitting the user to use the device, at will, in an audible or in a muted mode.

Figure 15:
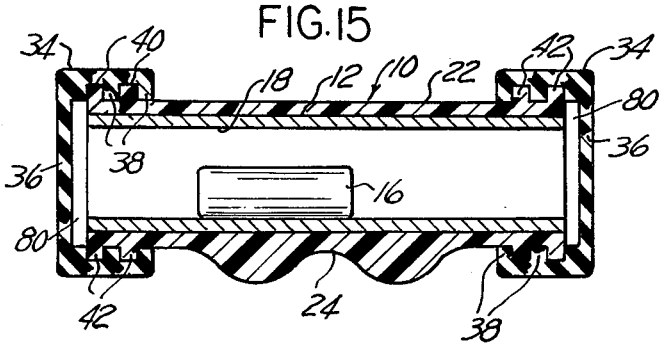
FIGS. 15–16 are views similar to FIG. 6 but showing a modification thereof.
Figure 16:
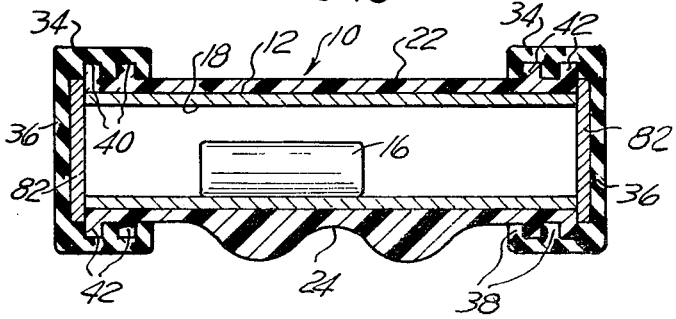

A similar convertible feature may be provided by a slight modification of, for example, the structure of FIG. 6 or FIG. 7. The modification consists simply, as shown at FIG. 15 in closing each end of the bore 18 of the tubular member 12, provided with a hand grip sleeve 22, by a snap-on closure cap 34 made of resilient elastomeric material, with the result that each time the weighted mass or slug 16 impacts upon an elastomeric end wall 36 formed by the top of the snap-on elastomeric closure cap 34, the impact shock is muted. An annular space 80 is provided between the end edges of the tubular member 12 and sleeve 22. The user of the device is thus enabled, after removing the end caps 34 and inserting a metallic disk 82 against the bottom of each end cap 34 and reinstalling the end caps 34 in position, to convert the rhythm indicator and exerciser device 10 to one having a solid closure wall at each end, each formed by a metallic disk 82 at each end of the bore 18 of the tubular member 12, FIG. 16. An audible knocking sound is thus obtained each time the weighted mass or slug 16 impacts upon the solid closure walls defined by the metallic disk 82. The rhythm indicator and exerciser device 10 of FIGS. 15–16 is supplied to the user in the form of a kit, for example without the metallic disk 82 installed in position but supplied separately, with appropriate instructions for the user to effectuate conversions from the muted mode to the audible mode.

The weighted mass or slug 16 may have any appropriate length as long as it is shorter than the overall length of the internal bore 18 of the tubular member 12 between the end walls so as to cause an impact sound to be faintly heard by the user, or felt by the hand of the user, when the weighted mass or slug 16 is forcibly projected such as to impact against a resilient end wall. It has been discovered that, in order for the impact shock to be heard faintly, or to be felt by the hand, the ratio of the overall length of the weighted mass or slug 16 to the total length of the internal bore 18 of the tubular member 12 between the end walls should preferably be at most 4 to 7. For example, if the total length of the bore 18 of the tubular member 12 between the closure end walls is 90 mm (about 3.5 inches), the overall length of the weighted mass or slug 16 is preferably not more than 50 mm (about 2 inches).

Having thus described the present invention by way of examples of structure given for illustrative purposes only, modifications whereof will be apparent to those skilled in the art,

What is claimed as new is as follows:

1. An exercising device comprising an elongated circularly cylindrical tubular member of a convenient diameter and length to be gripped by a hand, a longitudinal bore of substantially constant diameter extending from end to end within said elongated tubular member, a freely movable single-piece weighted mass within said bore adapted to be displaceable from end to end therein, said single-piece weighted mass having at least one dimension greater than one-half the diameter of said elongated tubular member, and a pair of closure walls, each of said closure walls being disposed at an end of said bore and having a surfce for impacting by an end surface of said single-piece weighted mass, wherein at least one of the surfaces in mutual engagement upon impact by said single-piece weighted mass with said closure wall is made of an elastomeric material for emitting a single muted sound upon impact shock of said weighted mass with a closure wall and the length of said tubular member is less than about 160 mm.

2. The device of claim 1 wherein said weighted mass is a solid metallic elongated slug and said closure walls are made of elastomeric material.

3. The device of claim 2 wherein said cylindrical tubular member has a solid closure wall at each end thereof and a plug of elastomeric material forming a resilient cushion is disposed in said bore on a side of each of said closure walls.

4. The device of claim 2 further comprising a sleeve enclosing said cylindrical tubular member and wherein said cylindrical tubular member has an elastomeric closure wall at each end thereof, at least one of said elastomeric walls being integral with said sleeve enclosing said cylindrical tubular member.

5. The device of claim 4 wherein the other of said elastomeric closure walls is integral with a second sleeve enclosing said first mentioned sleeve.

6. The device of claim 4 wherein the other of said elastomeric closure walls is an elastomeric closure cap attached over an open end of said sleeve.

7. The device of claim 4 wherein the other of said elastomeric closure walls is a portion of said sleeve enclosing said cylindrical tubular member.

8. The device of claim 1 wherein said closure walls are solid and said weighted mass has an elastomeric cushion at least at each end thereof.

9. The device of claim 1 wherein said closure walls are each a closure cap attached at an open end of said bore.

10. The device of claim 9 wherein said closure cap is made of elastomeric material.

11. The device of claim 10 wherein said closure cap is removable, and further comprising a solid metallic disk insertable in each closure cap for optionally providing a solid closure wall for said bore.

12. The device of claim 1 wherein said tubular member is provided at each end with a removable and reversible closure cap, said closure cap being in the form of a tubular member having a solid partition wall, and an elastomeric pad disposed on one side of said solid wall.

13. An exercising device comprising an elongated circularly cylindrical tubular member of a convenient diameter and length to be gripped by a hand, a longitudinal bore of substantially constant diameter extending from end to end within said elongated tubular member, a freely movable single-piece weighted mass within said bore adapted to be displaceable from end to end therein, and a pair of closure walls, each of said closure walls being disposed at an end of said bore and having a surface for impacting by an end surface of said single-piece weighted mass, wherein the length of said tubular member is less than about 160 mm and the ratio of the length of said single-piece weighted mass to the length of the bore in said elongated tubular member between said closure walls is at most 4 to 7 and wherein at least one of the surfaces in mutual engagement upon impact by said weighted mass with said closure wall is made of an elastomeric material for emitting a single muted sound upon impact shock of said single-piece weighted mass with a closure wall.

14. The device of claim 13 wherein said weighted mass is a solid metallic elongated slug and said closure walls are made of elastomeric material.

15. The device of claim 14 wherein said cylindrical tubular member has a solid closure wall at each end thereof and a plug of elastomeric material forming a resilient cushion is disposed in said bore on a side of each of said closure walls.

16. The device of claim 14 further comprising a sleeve enclosing said cylindrical tubular member and wherein said cylindrical tubular member has an elastomeric closure wall at each end thereof, at least one of said elastomeric walls being integral with said sleeve enclosing said cylindrical tubular member.

17. The device of claim 16 wherein the other of said elastomeric closure walls is integral with a second sleeve enclosing said first mentioned sleeve.

18. The device of claim 16 wherein the other of said elastomeric closure walls is an elastomeric closure cap attached over an open end of said sleeve.

19. The device of claim 16 wherein the other of said elastomeric closure walls is a portion of said sleeve enclosing said cylindrical tubular member.

20. The device of claim 13 wherein said closure walls are solid and said weighted mass has an elastomeric cushion at least at each end thereof.

21. The device of claim 13 wherein said closure walls are each a closure cap attached at an open end of said bore.

22. The device of claim 21 wherein said closure cap is made of elastomeric material.

23. The device of claim 22 wherein said closure cap is removable, and further comprising a solid metallic disk insertable in each closure cap for optionally providing a solid closure wall for said bore.

24. The device of claim 13 wherein said tubular member is provided at each end with a removable and reversible closure cap, said closure cap being in the form of a tubular member having a solid partition wall, and an elastomeric pad disposed on one side of said solid wall.

* * * * *